United States Patent [19]

Fukunaga et al.

[11] Patent Number: 4,543,968

[45] Date of Patent: Oct. 1, 1985

[54] HAIR STYLING APPLIANCE

[75] Inventors: Masao Fukunaga, Matsubara; Hiroshi Nonoguchi, Yao, both of Japan

[73] Assignee: Matsushita Electric Industrial Co., Ltd., Osaka, Japan

[21] Appl. No.: 486,294

[22] PCT Filed: Jul. 8, 1982

[86] PCT No.: PCT/JP82/00258

§ 371 Date: Mar. 15, 1983

§ 102(e) Date: Mar. 15, 1983

[87] PCT Pub. No.: WO83/00279

PCT Pub. Date: Feb. 3, 1983

[30] Foreign Application Priority Data

Jul. 15, 1981 [JP] Japan ..... 56-111502
Jul. 15, 1981 [JP] Japan ..... 56-111500

[51] Int. Cl.[4] ..... A45D 2/12

[52] U.S. Cl. ..... 132/33 R; 132/40; 132/36 R; 219/222

[58] Field of Search ..... 132/33 R, 36, 40

[56] References Cited

U.S. PATENT DOCUMENTS 3,478,755 11/1969 Jorgensen ..... 132/33 R
3,563,251 2/1971 Jorgensen ..... 132/33 R
3,603,765 9/1971 Underwood ..... 132/33 R

*Primary Examiner*—Gregory E. McNeill
*Attorney, Agent, or Firm*—Wenderoth, Lind & Ponack

[57] ABSTRACT

This invention relates to a hair styling appliance utilizing an inflammable gas as a source of heat for curling hair. A tank for the storage of the inflammable gas and a pressure regulator for adjusting the gas pressure are integrated together. By providing a gas inlet and gas outlet of the regulator so as to be oriented substantially at right angles to each other, the gas pressure is rendered constant to achieve a safe and stabilized combustion and, at the same time, the whole construction is miniaturized.

9 Claims, 12 Drawing Figures

HAIR STYLING APPLIANCE

FIELD OF THE INVENTION

BACKGROUND OF THE INVENTION

This invention relates to a portable hair styling appliance utilizing an inflammable gas as a source of heat for curling hair, which is effective to accomplish safe and stabilized combustion and which is reduced in size by miniaturizing the construction.

DESCRIPTION OF THE PRIOR ART

Hitherto, in portable appliances necessitating a source of heat, most of them are primarily of electric type or of a type utilizing a fuel such as gas or petroleum. However, the electric type using fuel is inconvenient in that it requires a cord whereas, in the cordless type such as gas or petroleum, it is difficult to achieve the supply of a stabilized amount of fuel because the vapor pressure of the gas tends to vary remarkedly with temperature. For this reason, the use of a regulator can be contemplated, but it tends to lead to the increased size and also to the increased price for the appliance. Accordingly, no sufficient measures have been taken at present despite the fact that the pressure regulation is necessary in portable, compact appliances such as a hair styling appliance.

SUMMARY OF THE INVENTION

Accordingly, this invention is such that, by integrating a storage tank for an inflammable gas together with a regulator for adjusting the gas pressure and also by providing a gas inlet and outlet so as to orient them generally at right angles to each other, the gas pressure is rendered constant irrespective of change in temperature thereby achieving a safe and stabilized combustion and, at the same time, the whole construction can be rendered compact even though the regulator is used.

DETAILED DESCRIPTION OF THE PREFERRED EMBODIMENTS

Figure 1:
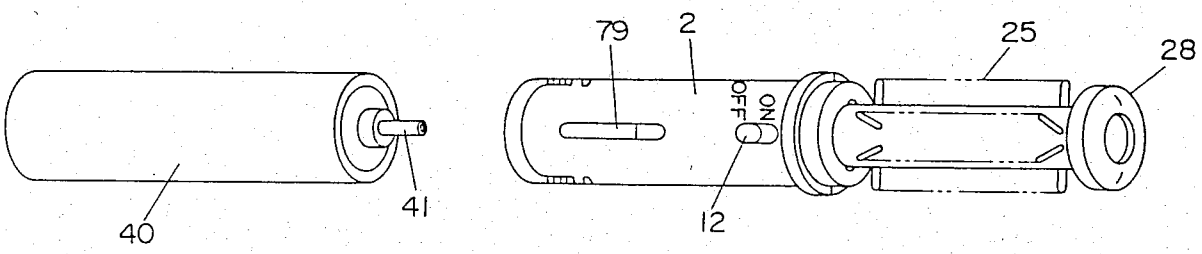
FIG. 1 is a perspective view showing the outer appearance of a gas cylinder and a hair styling appliance according to one embodiment of the invention.
Figure 2:
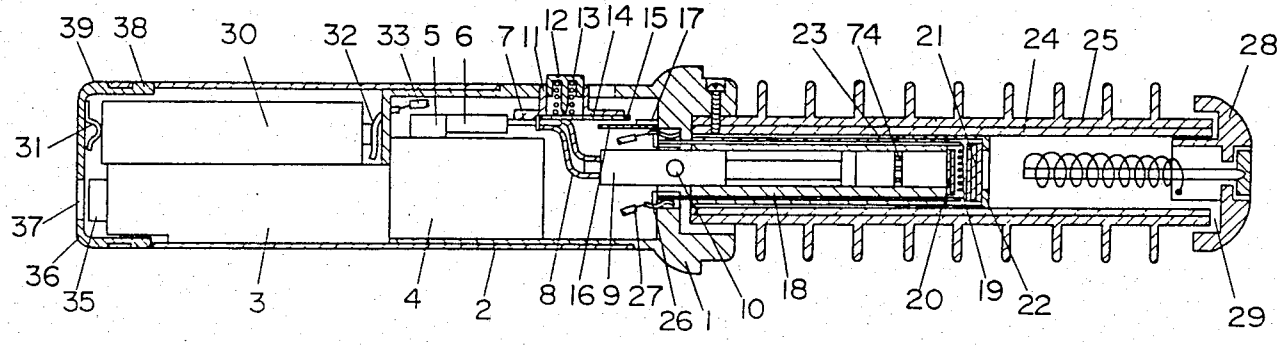
FIG. 2 is a sectional view of the hair styling appliance of FIG. 1.

A hair styling appliance according to one embodiment of this invention is shown in FIG. 1, and its basic construction comprises a body, a principal portion positioned at the tip thereof and a curler unit having a burner therein for styling hair. The combustion control of the burner is carried out through a switch manipulating unit provided in the body. While FIG. 2 shows the construction thereof, a body casing 1 constituting the body is covered by a body cover 2 and, within the interior of the body defined by them, there is accommodated a tank 3 for the storage of an inflammable gas and a pressure regulator 4 for adjusting the gas pressure. The pressure regulator 4 is fitted with a nozzle support 5 having a nozzle 7 mounted thereon through a nozzle holder 6 so as to extend in parallel to the pressure regulator 4. The nozzle 7 is in turn connected to a burner 9 through a piping 8. The burner 9 has an air intake port 10 defined therein for the introduction of air thereinto from the outside. In the body casing 1, a switch knob 12 mounted in a switch support 11 is provided in a manner biased in one direction by a spring 13, thereby constituting a switch manipulating unit. A switch terminal 14 movable to and fro in response to the forward and backward movement of the switch knob 12 is also mounted on the switch support 11. The switch terminal 14 has a contact area 15 at the tip thereof which faces a conductor area 17 on a switch board 16.

In the above described construction, an inflammable gas emerging from the tank 3 flows through the pressure regulator 4 and, after having passed in a pressure controlled manner through the nozzle support 5 and the nozzle holder 6, is discharged from the nozzle 7. It is so designed that the supply of the inflammable gas can be effected by moving the switch support 11 forward to pull the nozzle 7 forward thereby allowing a valve to open. The inflammable gas emerging from the nozzle 7 then enters the burner 9 through the piping 8 and is, after having drawn air through the air intake port 10 by the venturi effect, jetted in the form of a mixed gas of air and inflammable gas from the burner 9.

The tip of the burner 9 is located inside a heater holder 18 of electrically insulating material provided at one end of the body casing 1. Accordingly, the mixed gas flows through the inside of the heater holder 18 and then impinges upon a first catalyst 20 at the tip of the heater holder 18. The first catalyst 20 and a second catalyst 21 are retained by a catalyst retainer 22 and a heater 19 is positioned sandwiched therebetween. The heater 19 is arranged so that, when the switch support 11 is moved forward to pull the nozzle 7 to open and close the inflammable gas and when the switch knob 12 is then depressed, the contact area 15 of the switch terminal 14 moves downward to contact the conductor area 17 of the switch board 16 to establish a closed circuit through connectors 23 and 26 and lead wire 27 whereby the mixed gas is heated by the heater 19 to a temperature at which it undergoes a catalytic combustion. The mixed gas is catalytically burned by the first and second catalysts 20 and 21, the temperature of each of which has been raised, and generates heat energies which in turn increase the temperature of a curling pipe 24 positioned exteriorly thereof thereby increasing the temperature of a brush 25 exteriorly of the pipe to a value suitable for hair styling. Exhaust gases after the combustion are discharged to the outside through a clearance 29 in the curler cap 28 of the curling pipe 24 and are guided towards the brush 25. It is to be noted that the curling pipe 24 is removably mounted on the body casing 1 by means of screws or the like and constitutes a curler unit.

Within the body cover 2, there is arranged batteries 30 between terminals 31 and 32 and positioned in recesses defined in the tank 3 in parallel relation to the tank 3. The terminal 32 is connected to a heater circuit through a lead wire 33. A cap 36 is removably mounted on one end of the body cover 2 and is formed with a plug-in aperture 37 in alignment with an inflammable gas injection port 35. The cap 36 can be selectively removed from and mounted on the body cover 2 by compressing a gripping area 39 to manipulate a fitting area 38. The gas cylinder 40 (FIG. 1) is used to inject the gas into the tank 3 with its nozzle 41 inserted through the plug-in aperture 37. It is to be noted that the inflammable gas stored in the tank 3 may be an LP gas including butane or propane as its main component. This storage in the form of liquid makes it possible to minimize the capacity of the tank 3 and, since the vapor pressure is not so high relatively at a normal temperature, the design of the structure and the strength of the tank 3 can be carried out with no difficulty. Moreover, it is preferred because of the ready availability in respect of the ignitability, the stability and the amount of heat energies during the combustion.

Figure 3:
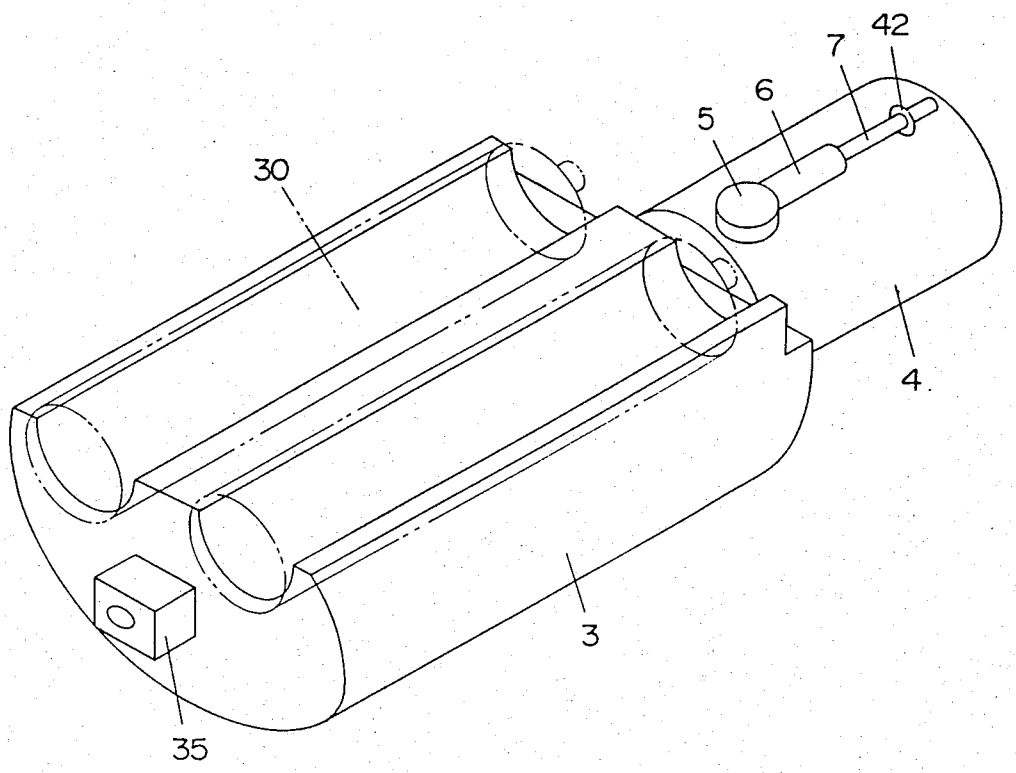
FIG. 3 is a perspective view showing an associated construction between a tank and a pressure regulator.
Figure 4:
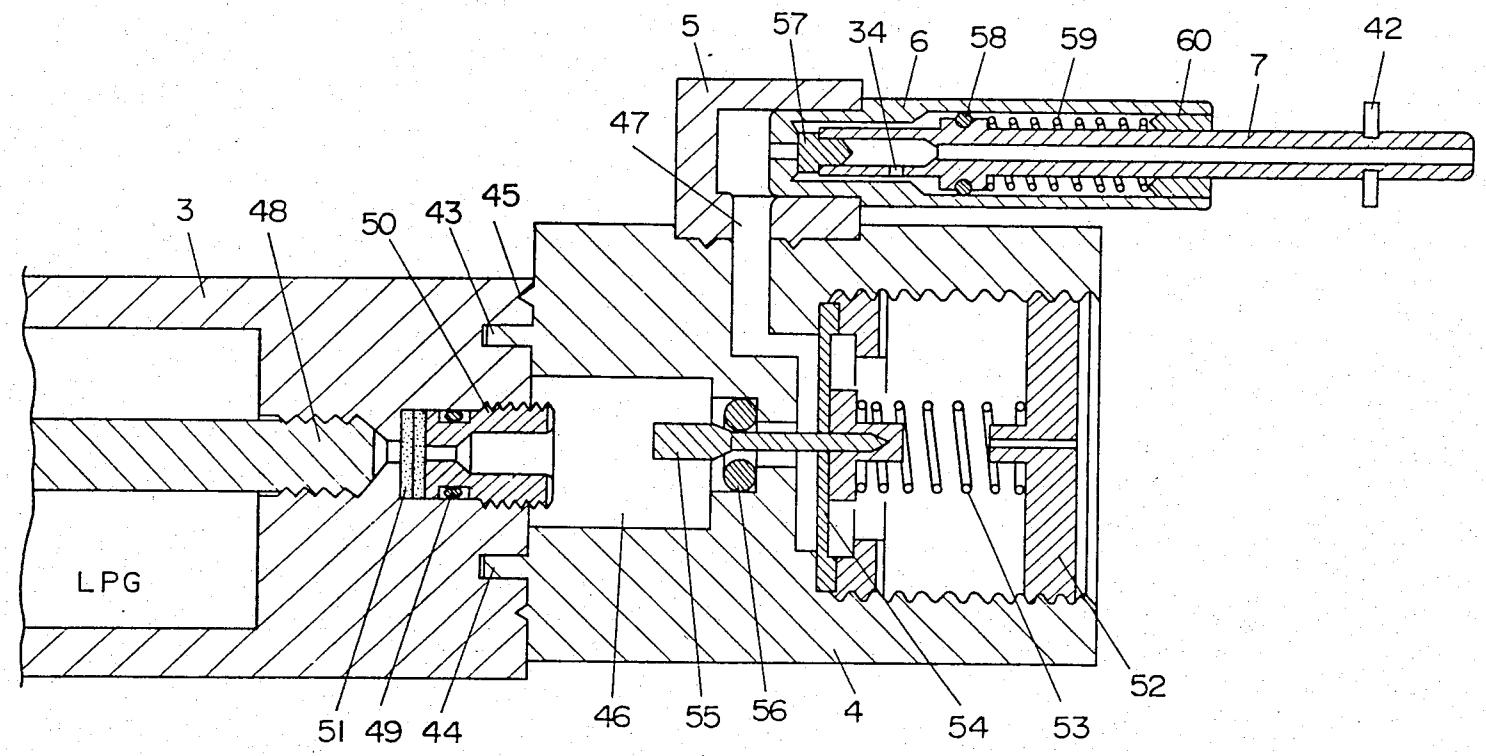
FIG. 4 is a sectional view, on an enlarged scale, of an essential portion of FIG. 3.

And, as shown in FIGS. 3 and 4, the tank 3 and the pressure regulator 4 are made of resin and are integrally connected together by fusing at a weld area 45 while engagement indents 43 are engaged with positioning area 44 for the engagement indents in a non-rotatable manner. Because of this arrangement, no piping between the tank 3 and the regulator 4 is required, thereby making it possible to minimize the size with the increased reliability and strength of the sealed interface. In this embodiment, the welding at the weld area 45 is carried out by the use of an ultrasonic wave. Alternatively, it is possible to form the weld area 45 by the utilization of the area of the engagement indents 43. Moreover, as is the case with the welding between the tank 3 and the regulator 4, the nozzle support 5 is also fusion bonded to the regulator 4 by the use of an ultrasonic wave.

The gas outlet 47 is provided on a side face of the regulator 4 so as to face in a direction substantially at right angles to the gas inlet 46 of the regulator 4. This arrangement is for the purpose of minimizing the longitudinal dimension so that the appliance can be rendered compact when the nozzle 7 is pulled by the switch support 11 (FIG. 2) through a ring 42 (FIGS. 3 and 4).

The pressure regulation will now be described. The LP gas enters the gas inlet 46 in the gasified form through a cotton wick 48 after the pressure has been reduced by urethane pressure reducer 51 compressed by urethane pressure reducer retaining screw 50 sealed by an O-ring 49. The pressure adjustment is such that a diaphragm 54, adapted to receive a pressure from the front by the action of a pressure adjusting spring 53 compressed by a pressure adjusting screw 52 and also to receive a gas pressure from the rear is displaced to and fro by the difference between the gas pressure and the spring force whereby, when the gas pressure is high, a pressure adjusting pin 55 reduces a clearance between it and a pressure adjusting packing 56 to reduce the gas pressure in the gas outlet 47, whereas when the pressure in the gas inlet 46 is low, the diaphragm 54 is displaced rearwards and, therefore, the action reverse to that described above takes place to increase the gas pressure in the gas outlet 47, wherefore the gas pressure in the gas outlet 47 can be kept constant. A nozzle packing 57 interrupts and establishes the flow of the gas towards the nozzle 7, and the nozzle 7 is sealed by a nozzle O-ring 58 and applied with a force by a nozzle spring 59, non-removably set in position by a nozzle spring retainer 60, in a direction necessary to interrupt the flow of the gas. On one side adjacent the nozzle packing 57, the nozzle 7 is formed with a gas passage 34 through which the inflammable gas flows into the nozzle 7.

Figure 5:
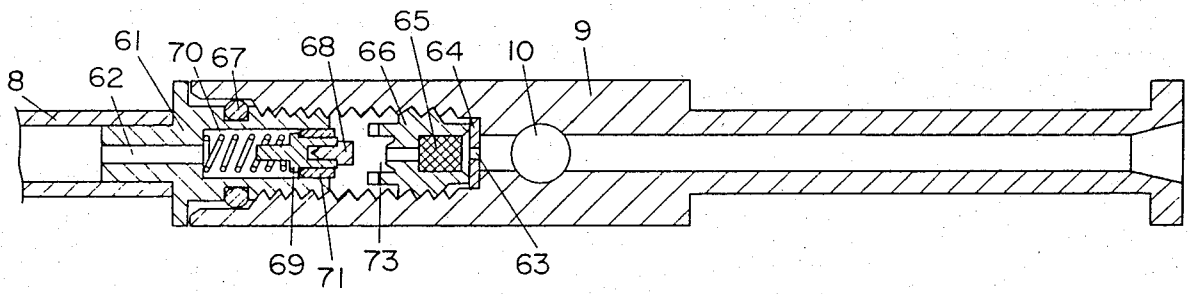
FIGS. 5 and 6 are sectional views, on an enlarged scale, of a burner unit in a normal condition and an abnormal condition, respectively.
Figure 6:
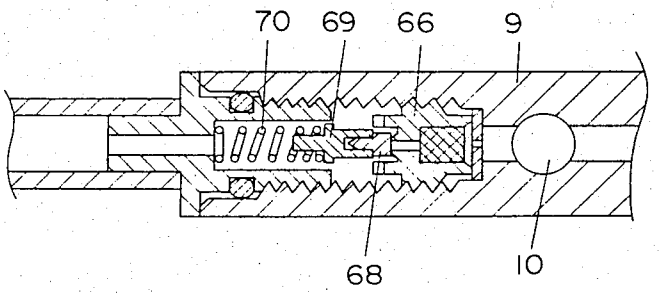
Figure 7:
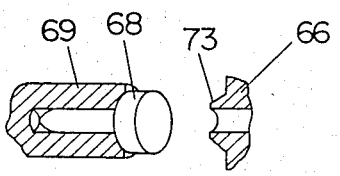
FIG. 7 is a perspective view showing an essential portion of the burner in sectional representation.
Figure 8:
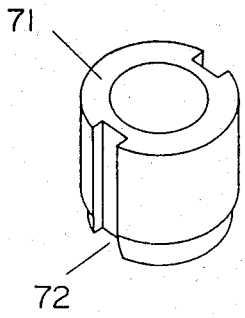
FIG. 8 is a perspective view of a safety part.

FIG. 5 illustrates an interior structure of the burner 9. The gas supplied through the piping 8 flows into the burner 9 through an inlet portion 62 in a burner inlet piece 61. Within the burner 9, there is fitted a ring 64 having a fine aperture 63 (10 to 200 μm in diameter was found appropriate) forming an orifice necessary to accelerate the flow of the gas in an amount necessary to achieve combustion and to draw the air through the air intake port 10 by the venturi effect. This fitting is carried out by threading a ring retainer 66, having a filter 65 of sintered metal alloy built therein, to seal so that the gas can be swept off. In addition, within the burner inlet piece 61 sealed by a burner piece O-ring 67, a safety valve 69 having a T-shaped packing 68 at the tip thereof is positioned as shown in FIG. 5. The safety valve 69 is, while applied with a pressure by a safety valve spring 70, inserted in a safety metal part 71 having a gas passage 72 of a shape as shown in FIG. 8, and the safety metal part 71 pressure-fitted into the burner inlet piece 61. This arrangement is for the purpose that, in the event that a large amount of the gas flows to the burner unit with the combustion temperature consequently increased abnormally by reason of the occurrence of any accident, the heat thereof is transmitted to the burner 9 to melt the safety metal part 71, which is a metal of low melting point, so that the safety valve 9 can be pushed forward by the safety valve spring 70 as shown in FIG. 6 thereby allowing the T-shaped packing 68 to abut a ring retainer inlet 73 in the ring retainer 66 to interrupt the flow of the gas from the burner 9, said ring retainer inlet 73 having a shape similar to a crater and capable of giving a sealing effect.

Figure 9:
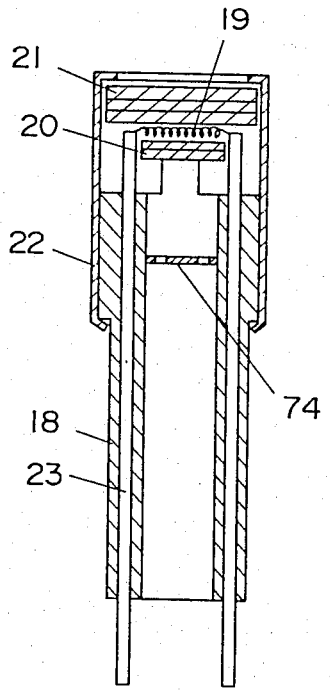
FIG. 9 is a sectional view showing the relationship between an igniter heater and catalysts.
Figure 10:
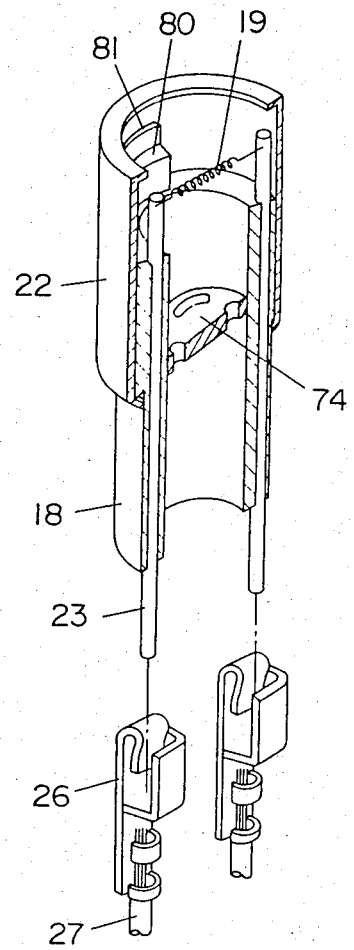
FIG. 10 is an exploded view showing connector areas for the igniter.

A unit portion of the heater holder 18 is shown in FIG. 9 while a structure with the catalysts 20 and 21 removed is shown in FIG. 10. This unit is featured in that, since the life time of each of the heater 19 and the catalysts 20 and 21 is approximately 100 hours, the connectors 23 supporting the heater 19 and the connectors 26 secured in the body casing 1 are releasably engaged to each other in readiness for the replacement and in that the heater holder 18 is provided with support steps 80 and 81 for holding the catalysts so that the heater 19 and the catalysts 20 and 21 can be kept assuredly in predetermined contact with each other to achieve an assured ignition. Within the heater holder 18, there is fitted a rectifier plate 74 for causing the flow of the gas to be directed towards the surfaces of the catalysts 20 and 21.

Figure 11:
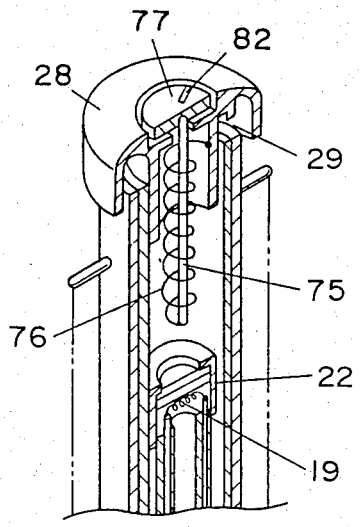
FIG. 11 is a perspective view showing the burner unit and a combustion display area in sectional representation.

FIG. 11 illustrates a structure for facilitating the confirmation of an ignited condition and the detection of the combustion temperature. The previously mentioned curler cap 28 is provided with a spiral biometal 76 having a portion connected to the curler cap 28 and the other end secured to a bimetal shaft 75 as shown. This bimetal 76 serves in such a manner that, when the heater 19 is heated to a red hot condition to initiate combustion with the gas starting combustion at the catalysts 20 and 21, the temperature thereof is immediately detected and the bimetal 76 exerts a rotational force with which the bimetal shaft 75 is rotated with a rotary member 77 at the tip thereof consequently rotated so that the ignited condition can be acknowledged by the position of a display indicia 82 thereof and the fact that the heater 19 need not be supplied with an electric current can be acknowledged for the ultimate purpose of saving the life time of the heater 19 and that of the batteries 30 (FIGS. 2 and 3).

Figure 12:
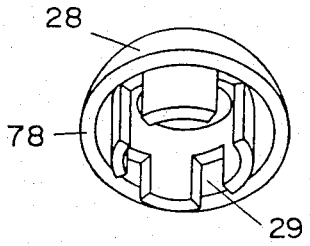
FIG. 12 is a perspective view of a curler cap.

In addition, since the angle of rotation varies depending on the combustion temperature, the combustion temperature at a particular time can also be ascertained. Although the outer appearance of the curler cap 28 is shown in FIG. 12, the exhaust gases are adapted to flow through the clearance 29. Moreover, in order for the exhaust gases to escape downwards, a skirt 78 is so provided to avoid a danger due to the forward flow of the exhaust gases. Furthermore, the water vapor of the exhaust gases is adapted to be guided by the skirt 78 towards the brush 25 (FIG. 1) and then towards the hair to facilitate the hair styling.

In addition, in this embodiment, the body cover 2 is, as shown in FIG. 1, provided with a slit 79 so that the tank 3 (FIG. 2) can be viewed from the outside to check the liquidized gas remaining in the tank 3. Moreover, by providing this slit 79 at two locations diagonal with each other, light is allowed to pass so that the amount of the liquidized gas remaining in the tank 3 can more easily be checked.

Further, as shown in FIG. 3, the tank 3 has generally cylindrical recesses at its upper portion for accommodating batteries 30 shown by the chain lines. Therefore, the various elements can be accommodated within the cylindrical body, thereby rendering it compact.

As hereinbefore described, the hair styling appliance of this invention has its entire structure miniaturized and rendered compact even though the pressure regulator is used, because use is made of the pressure regulator for adjusting the gas pressure at a constant value irrespective of change in temperature so that safe and steady combustion can be attained and because the tank for the storage of the inflammable gas and the pressure regulator are integrated together with the gas outlet arranged substantially at right angles to the gas inlet.

We claim:

1. A hair styling appliance which comprises:

a hollow body having a battery chamber defined therein for replaceably accommodating at least one battery;

a tank housed within the body for accommodating liquefied inflammable gas;

a pressure regulator housed within the body and having a gas inlet and a gas outlet, said pressure regulator being positioned in abutting relation to the tank with the gas inlet in fluid connection with the interior of the tank;

a nozzle positioned within the body in fluid connection with the gas outlet, said pressure regulator being operable to regulate the pressure of the inflammable gas flowing therethrough towards the nozzle from the tank;

a burner having a gas supply port and a gas discharge port and carried by the body at one end thereof with the gas supply port and the gas discharge port positioned inside and outside the body, respectively, said gas supply port being communicated with the tank through the nozzle and the pressure regulator;

a curling unit having one end connected to the body with the gas discharge port of the burner positioned inside said curling unit, said curling unit also having a brush provided exteriorly thereof;

a means for igniting the inflammable gas when energized by the supply of power from the battery;

at least one catalyst element positioned within the curling unit adjacent the igniting means;

a manipulable switch assembly movable between first and second positions, said switch assembly, when in the first position completing not only an electric circuit between the battery and the igniting means, but also a fluid circuit between the nozzle and the burner, whereby the inflammable gas discharged from the discharge port of the burner can be ignited to heat the curling unit for hair styling, and said switch assembly, when in the second position, closing both of said electric circuit and said fluid circuit.

2. A hair styling appliance as defined in claim 1, wherein the tank and the regulator are made of resin and are fusion-bonded together after having been positioned in end-to-end abutting relation with each other by means of engagement indents.

3. A hair styling appliance as defined in claim 1, wherein the nozzle is moved to supply the inflammable gas to the nozzle by the operation of said manipulable switch assembly in the body.

4. A hair styling appliance as defined in claim 1, wherein the igniting means is a heater.

5. A hair styling appliance as defined in claim 1, further comprising: connector means for supporting said burner being coupled to the body.

6. A hair styling appliance as defined in claim 1, wherein the curling unit is provided therein with a bimetal deformable under the influence of combustion heat, said bimetal being provided with a means for visually displaying to the outside the deformation of the bimetal.

7. A hair styling appliance as defined in claim 1, wherein the curling unit is provided with means for guiding combustion exhaust gases towards the brush.

8. A hair styling appliance as defined in claim 1, wherein the at least one battery is accommodated in the battery chamber of the body so as to extend in parallel relation to the longitudinal axis of the body.

9. A hair styling appliance as defined in claim 1, wherein the body is provided with at least one slit through which the amount of the gas in the tank can be checked.

* * * * *